US006507982B2

(12) United States Patent
Kawamura

(10) Patent No.: US 6,507,982 B2
(45) Date of Patent: Jan. 21, 2003

(54) BUCKLE

(75) Inventor: Ryoji Kawamura, Taipei (TW)

(73) Assignee: YKK Corporation, Tokyo (JP)

( * ) Notice: Subject to any disclaimer, the term of this patent is extended or adjusted under 35 U.S.C. 154(b) by 0 days.

(21) Appl. No.: 09/892,484

(22) Filed: Jun. 28, 2001

(65) Prior Publication Data

US 2002/0017011 A1 Feb. 14, 2002

(30) Foreign Application Priority Data

Jun. 30, 2000 (JP) ..... 2000-199478

(51) Int. Cl.[7] ..... A44B 11/25

(52) U.S. Cl. ..... 24/615; 24/616; 24/625; 24/633; 24/623

(58) Field of Search ..... 24/615, 616, 617, 24/623, 625

(56) References Cited

U.S. PATENT DOCUMENTS

| | | | | | |
|---|---|---|---|---|---|
| 5,309,610 | A | | 5/1994 | le Gal | |
| 5,311,649 | A | * | 5/1994 | Suh | 24/625 |
| 5,459,910 | A | * | 10/1995 | Anscher | 24/625 |
| 5,465,472 | A | * | 11/1995 | Matoba | 24/625 |
| 5,584,106 | A | | 12/1996 | Anscher | |
| 5,791,026 | A | | 8/1998 | Anscher | |
| 5,926,928 | A | | 7/1999 | Lundstedt | |
| 6,052,875 | A | * | 4/2000 | Fudaki | 24/625 |

FOREIGN PATENT DOCUMENTS

| | | | | |
|---|---|---|---|---|
| EP | 0 681 793 | | 11/1995 | |
| FR | 2451175 | * | 11/1980 | 24/616 |
| GB | 2150632 | * | 7/1985 | 24/633 |
| GB | 2 262 962 | | 7/1993 | |

OTHER PUBLICATIONS

European Search Report in Application No. 01114873.1 dated Oct. 12, 2001.

* cited by examiner

*Primary Examiner*—Victor Sakran
(74) *Attorney, Agent, or Firm*—Finnegan, Henderson, Farabow, Garrett & Dunner, L.L.P.

(57) ABSTRACT

The invention provides a buckle which is formed from a buckle main body and an insert-in body, and which has a good appearance in which a belt attaching portion is hidden from view. The buckle is formed from a buckle main body and an insert-in body. The insert-in body is provided with engaging rods and a guide rod. The engaging rods are provided at both sides of a base portion of the insert-in body and have engaging portions which engage with engaging holes of the buckle main body. The guide rod is provided at a center of the base portion and can be inserted into an insert-in hole of the buckle main body. At an opposite surface of the base portion are provided a lower surface plate having a belt attaching portion, and an upper surface plate which covers a surface of the lower surface plate. A belt insertion hole into which the belt is inserted is formed between the upper surface plate and the lower surface plate. The buckle main body is formed from an upper surface plate, a lower surface plate and side walls. The insert-in hole into which the insert-in body is inserted is provided at one end of the buckle main body. At another end of the buckle main body, a belt insertion hole into which the belt can be inserted is provided. An attaching portion to which the belt is attached is provided at an end portion of the lower surface plate. Through holes, for passage of the belt being inserted through the insertion hole, are provided at the belt attaching portions. The engaging holes, which can engage with the engaging rods of the insert-in body, are formed in the side walls.

6 Claims, 14 Drawing Sheets

〈PRIOR ART〉

〈PRIOR ART〉

BUCKLE

BACKGROUND OF THE INVENTION

1. Field of the Invention

The invention relates to a buckle utilizing an insert-in operation of female and male members, i.e., a buckle main body and an insert-in body, and relates to a buckle for fastening a belt which is generally used in cloths, bags, helmets, strollers, sport instruments, or the like.

2. Description of the Related Art

A conventional buckle of this type formed from a buckle main body and an insert-in body is disclosed in U.S. Pat. No. 5,309,610. The buckle is formed from a flat tubular body as shown in FIG. 18. The buckle has, at one end side thereof, a buckle main body 1' which is provided with openings 8' at both sides thereof, and a belt attaching portion having a belt folded-over portion and a fitting rod 31'. A pair of flexible operation rods 16' project, at both sides, from the belt attaching portion 9' toward the other end side. An engaging portion 17' is provided at the outer side surface of each of the operation rods 16'. The engaging portions 17' engage with the opening portions 8' of the buckle main body 1'. In this buckle, an upper surface plate 3' of the buckle main body 1' extends such that an extended portion 32' is formed. When the buckle main body 1' and the insert-in body 2' are engaged, the belt catches on a fold-over rod 25', and the extended portion 32' of the upper surface plate 3' of the buckle main body 1' is compressed against the upper surface of the belt which is in a folded-over state. With such a structure, loosening of the belt is prevented, and the folded-over portion of the belt is hidden and cannot be viewed from the top surface.

Further, the buckle shown in FIG. 19 is generally well-known. The buckle is formed from a buckle main body 1" and an insert-in body 2". The buckle main body 1" is formed from a flat tubular body. Opening portions 8", which can engage with engaging portions 17" provided at operation rods 16" of the insert-in body 2", are provided at both side surfaces of the buckle main body 1". Further, the insert-in body 2" is provided with a belt fitting rod 31", and at the inner side thereof, a belt fold-over rod 25" having a step portion is provided, and at the inner side thereof, a base rod 15" is provided. Further, a pair of operation rods 16" are formed to project at the insert-in body 2". Elastic projections 33" are elastically in contact toward the step portion 34" of the belt fold-over rod 25", and the pair of operation rods 16", having the engaging portions 17" outer side thereof, are protruded toward the inner side of the insert-in body 2". When the buckle is to be used, the belt is made to catch on the fold-over rod 25" and is folded over. By making the elastic projections 33" elastically project toward the step portion 34", the belt is press-contacted, and loosening of the belt is prevented.

In the above-described buckle shown in FIG. 18, when the insert-in body 2' is inserted into and engaged with the buckle main body 1', an attaching portion 28', where the belt is attached to the fold-over rod 25' of the insert-in body 2', is hidden by the upper surface plate 3' of the buckle main body 1' and cannot be seen from the surface. However, the attaching portion 9' of the buckle main body 1' to which the belt is attached, is exposed and can be seen. Further, when the insert-in body 2' itself is viewed, the attaching portion 28' of the belt is exposed, and the buckle doesn't have a structure in which the belt attaching portions 9', 28' of the buckle main body 1' and the insert-in body 2' are completely hidden. Moreover, a problem arises in that the buckle at the extended portion of the upper surface plate 3' of the buckle main body 1' is thick and unseemly, and the buckle doesn't have preferable form from the standpoint of design.

Further, in the conventionally well-known buckle shown in FIG. 19 as well, the attaching portions for attaching of the belt to the buckle main body 1" and the insert-in body 2" are completely exposed, and the outer appearances are not good from the standpoint of ornamentation. In addition, there is the problem that the buckle itself is based on a straight line, and thus, the buckle doesn't have a preferable form from the standpoint of design.

SUMMARY OF THE INVENTION

The invention was invented in consideration of the aforementioned problems. In the invention, the main object of is to provide a buckle which is formed from a buckle main body and an insert-in body, and in which belt attaching portions provided at the buckle main body and at the insert-in body are hidden, such that the buckle is very beautiful from the standpoint of design, and furthermore, in which an attachment of the belt is easy and the strength of the attachment is ensured.

And another object of the invention is to provide a buckle in which, by specifying the form of guide rods of the insert-in body, sturdy guide rods are formed, insertion and removal operations of the insert-in body are carried out smoothly, and attaching of a logo mark or the like to the buckle main body is convenient.

Further object of the invention is to provide a buckle equipped with a function which allows easy adjustment of a belt with respect to a hidden-type belt attaching portion provided at the insert-in body.

Still further object of the invention is to provide a buckle provided with a function which allows smooth insertion and removal operations of the guide rods of the insert-in body, by specifying the form of the buckle main body.

And further object of the invention is to provide a buckle provided with a function which allows a logo mark or the like to be set easily by a post-attachment operation onto the surface of the buckle main body.

It is also another object of the invention to provide a buckle in which a belt insertion hole is provided so as to secure the insertion of the belt, and the lower surface plate may not be viewed from the top surface of the insert-in body.

And another object of the invention is to provide a buckle in which the insert-in body is effectively utilized such that a belt adjustment portion can be provided easily, and in which the buckle main body and the insert-in body are formed not on the basis of straight lines but on the basis of arc shaped curves such that the buckle has an excellent design.

In order to achieve the aforementioned objects, according to the main aspect of the invention, there is provided a buckle, wherein the buckle is formed from a buckle main body and an insert-in body, and engaging rods, which have engaging portions at outer sides thereof, are provided at both sides of a base portion of an insert-in body, and guide rods are provided at a center of the base portion, and at an opposite surface of the base portion are provided a lower surface plate having a belt attaching portion and an upper surface plate covering a surface of the lower surface plate, and a belt insertion hole in which the belt is inserted is formed between the upper surface plate and the lower surface plate, and the buckle main body is formed from an upper surface plate, a lower surface plate, and side walls, and an insert-in hole for the insert-in body is provided at one end of the buckle main body, and a belt insertion hole is provided at another end of the buckle main body, and a belt attaching portion is provided at an end portion of the lower surface plate, and through holes for a belt which communicate with the belt insertion holes are formed at the belt attaching portions, and engaging holes which engage with the engaging rods of the insert-in body are provided at the side walls. Therefore, there are the effects that the belt attaching portions provided at the buckle main body and the insert-in body are hidden and cannot be seen from the surface of a buckle. Thus, a buckle which has a pleasant appearance and is very beautiful from the standpoint of design can be obtained. Furthermore, the attachment operation of the belt is easy, and the belt can be fixed strongly.

Preferably, the guide rod is provided at the center of the base portion of the insert-in body, and the guide rod is formed in a shape such that a lateral cross sectional configuration thereof is H-shaped or a shape whose upper side is open. Thus, there is the effect that sturdy guide rods are formed, and even if a logo mark or the like is attached to the surface of the buckle main body, smooth engagement and disengagement operations may be carried out without being interfered by the guide rods.

Also preferably, the two holes for a belt are formed at least one of the belt attaching portions, and a catch rod for catching the belt is formed between the through holes, and a surface of the catch rod is formed in an uneven shape so as to form a belt adjustment portion. Further, the state of the belt placed at the belt adjustment portion is maintained in a horizontal state with respect to the upper and lower surface plates, even if an external force in any direction is applied to the belt. Consequently, an insert-in body, in which the belt does not become loose, is therefore obtained Further preferably, a partition wall, which connects the upper and lower surface plates along a central longitudinal direction of the buckle main body and extends from the insert-in hole to the through hole of the buckle main body, is provided at the buckle main body, and guide grooves which guide the guide rods of the insert-in body are formed at both sides of the partition wall.

And further, in order to attach a logo mark or the like to the upper surface plate of the buckle main body, attachment holes for the logo mark which communicate with right and left guide grooves are drilled in the upper surface plate of the buckle main body. Thus, there is the effect that a logo mark or the like can be very easily attached to the buckle main body, and a buckle which is valuable from the standpoint of ornamentation as well can be obtained.

Further, support portions are formed to project at both of right and left sides of the insert-in body, the upper surface plate is disposed in a bridge-like manner so as to connect the surfaces of the support portions and the lower surface plate is disposed in a bridge-like manner so as to connect the rear surfaces of the support portions, and the belt insertion hole is provided between both of the supporting portions, and the upper surface plate and the lower surface plate. Thus, there is the effect that the upper surface plate and lower surface plate overlap each other, and the lower surface plate is not viewed from the top surface of the insert-in body with the existence of the upper surface plate.

Still further, the base portion of the insert-in body is swelled out in an arc shape, and the belt adjustment portion is provided at an enlarged portion of the lower surface plate, and a belt insertion hole side of the insert-in body is formed in an arc shape, and the insert-in hole side for the insert-in body of the buckle main body is cut in a curved shape, and both side end portions of the insert-in hole of the buckle main body are formed in projected configurations, and a belt insertion hole side is formed in an arc shape. Thus, there is the effect that both of the buckle main body and the insert-in body are formed in shapes based on arc shaped curves, such that the buckle is easy to grasp and operation thereof is easy. Further, the length adjustment portion provided at the buckle is formed at an enlarged portion of the rear surface of the insert-in body. Therefore, this invention achieves marked effects such as the rear surface is effectively utilized, and a buckle, which is beautiful from the standpoint of design, is obtained.

DESCRIPTION OF THE PREFERRED EMBODIMENTS

Hereinafter, embodiments of a buckle of the present invention will be concretely described with reference to the drawings.

Figure 1:
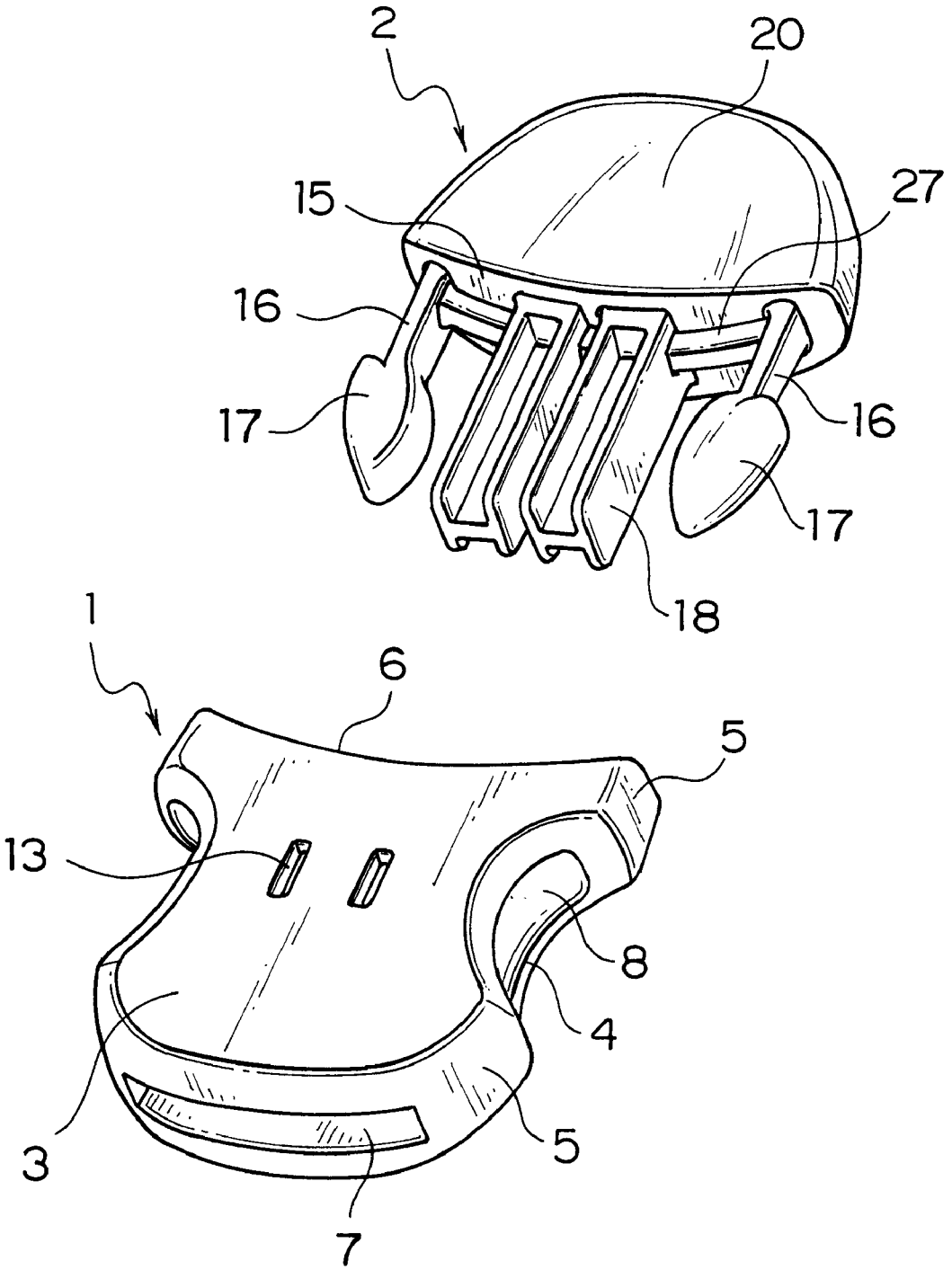
FIG. 1 is a perspective view of a buckle formed from a buckle main body and an insert-in body.

As shown in FIG. 1, according to the first embodiment of the invention, a buckle is formed from a buckle main body 1 and an insert-in body 2, and is a buckle in which the insert-in body 2 is freely insertiable into and removable from the buckle main body 1. The buckle main body 1 and the insert-in body 2 are respectively molded integrally by an injection molding process or an extrusion molding process by using a thermoplastic resin such as polyacetal, polyamide, polypropylene, polybutylene terephthalate, or the like.

Figure 7:
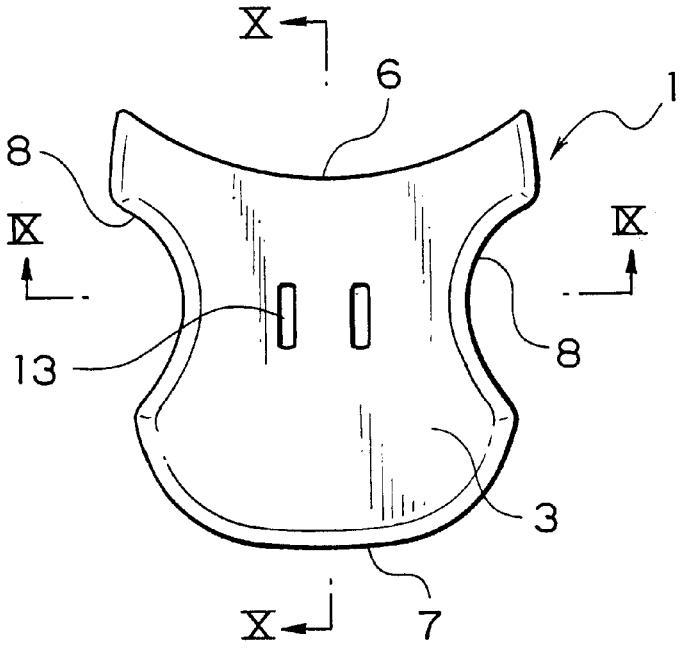
FIG. 7 is a plan view of the buckle main body.
Figure 8:
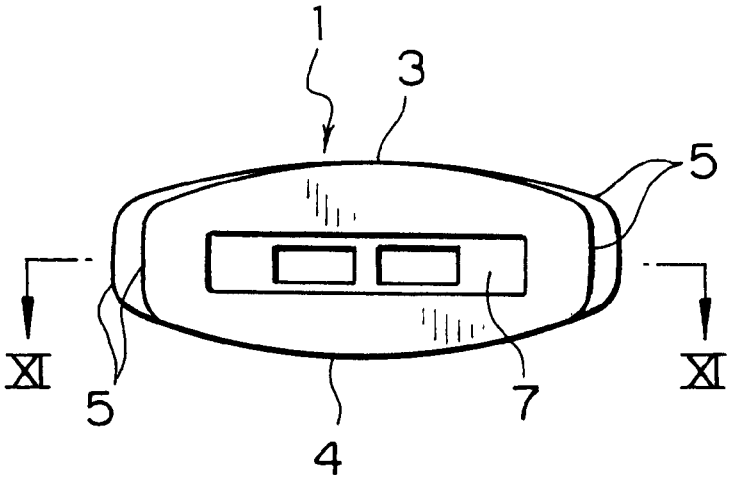
FIG. 8 is a front view of the buckle main body.

The buckle main body 1 of the buckle is a flat tubular body which is formed from an upper surface plate 3, a lower surface plate 4, and side walls 5 which connect the upper surface plate 3 and the lower surface plate 4, as shown in FIG. 1. The buckle main body 1 is provided, at one end thereof, with an insert-in hole 6 into which the insert-in body 2 is inserted, and, at the other end thereof, with a belt insertion hole 7 for inserting a belt. The buckle main body 1 has, at each of the side walls 5, an engaging hole 8 which has an opening shape and with which can engage an engaging portion 17 of an engaging rod 16 which is provided at the insert-in body 2. Further, when the buckle main body 1 is seen in plan view, as shown in FIG. 7, the insert-in hole 6 side is cut in curved shape, and the belt insertion hole 7 side swells out in an arc shape. The engaging hole 8 is curved in a shape of cutting out, in an arc shape, the side surface at which the side wall 5 smoothly swells in an arc-shape. The entire buckle main body 1 is formed on the basis of curves.

Figure 9:
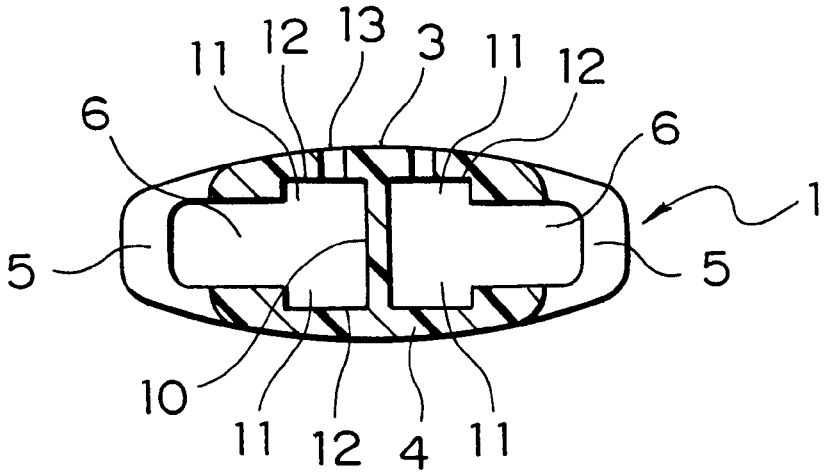
FIG. 9 is a cross-sectional view of the buckle main body taken along the line IX—IX in FIG. 7.
Figure 10:
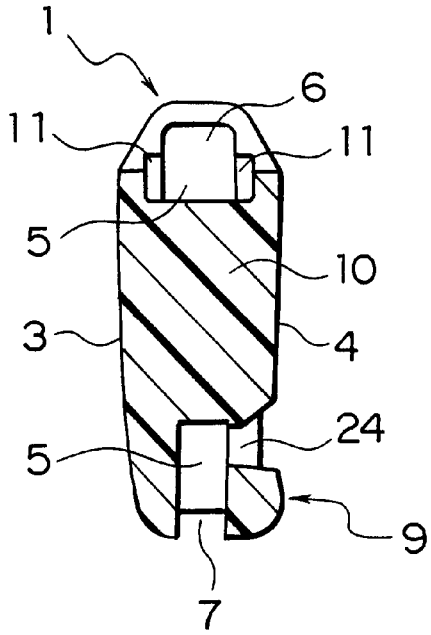
FIG. 10 is a cross-sectional view of the buckle main body taken along the line X—X in FIG. 7.
Figure 11:
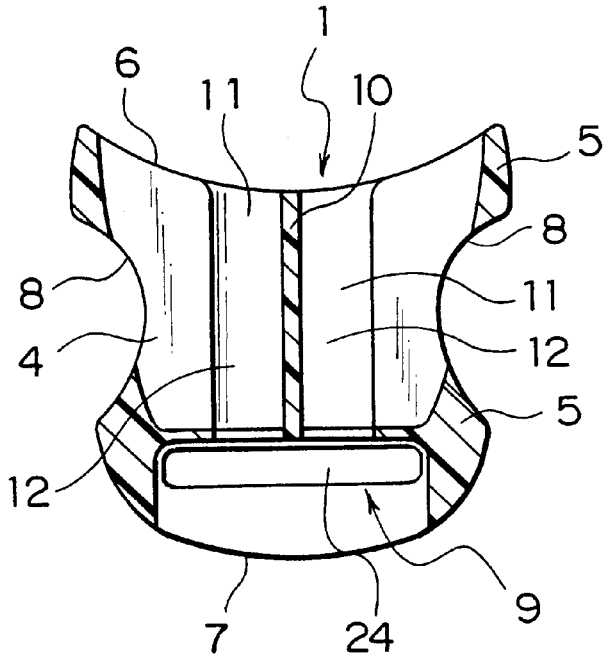
FIG. 11 is a cross-sectional view of the buckle main body taken along the line XI—XI in FIG. 8.
Figure 12:
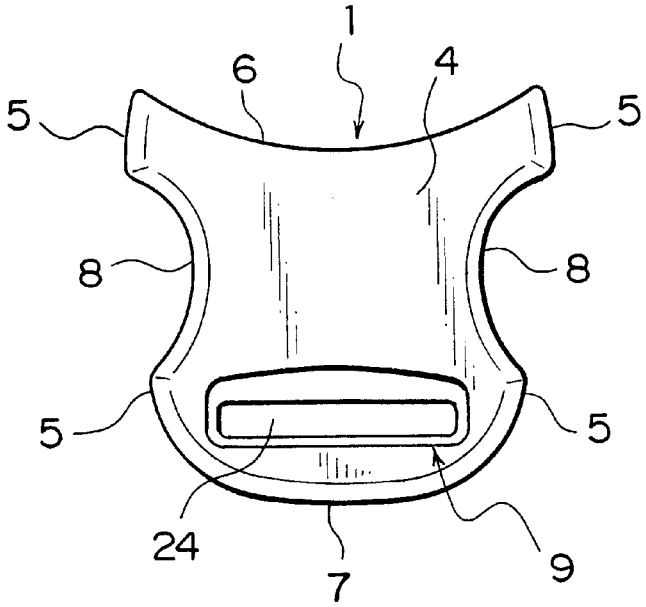
FIG. 12 is bottom view of the buckle main body.

As shown in FIG. 12, the lower surface plate 4 of the buckle main body 1 is provided with a belt attaching portion 9 for attaching the belt to the belt insertion hole 7 side. A through hole 24 for inserting the belt is formed at the attaching portion 9. As shown in FIG. 9, a partition wall 10 is provided which connects, along the central longitudinal direction, the lower surface plate 4 which is below and the upper surface plate 3 which is above. The partition wall 10 extends from the insert-in hole 6 to the through hole 24, and divides the interior of the buckle main body 1. Thus, at the both sides of the partition wall 10, guide grooves 11 are formed. Guide rods 18 which are formed to project at the insert-in body 2 are inserted into and guided in the guide grooves 11. The guide grooves 11 are protruded by forming concave portions 12, which are spaced apart at determined interval, in the inner surfaces of the upper surface plate 3 and the lower surface plate 4. Further, in the upper surface plate 3, as shown in FIGS. 7 and 9, attachment holes 13 which communicate with right and left of the guide grooves 11, are drilled for attaching a logo mark 14 or the like. The buckle main body 1 is thus shaped in a flat, rugby ball shape as seen from the side of the belt insertion hole 7.

Figure 2:
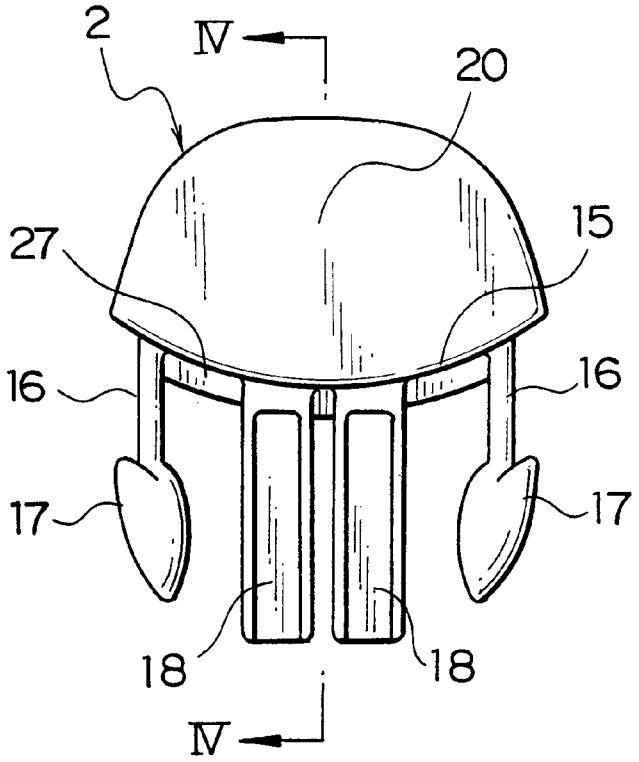
FIG. 2 is a plan view of the insert-in body.

On the other hand, as shown in FIGS. 1 and 2, the engaging rods 16 are protruded elastically so as to be parallel to one another at the both side ends of the base portion 15, which swells out in an arc shape, of the insert-in body 2. An engaging portion 17, which is projection shaped and can engage with the engaging hole 8 of the buckle main body 1, is formed at the outer side of the engaging rod 16. Further, at the center of the base portion 15, the guide rods 18, which can be inserted into the guide grooves 11 provided at the buckle main body 1, are formed to project in a parallel state with an interval therebetween which is equal to the thickness of the partition wall 10. The guide rod 18 is formed such that the cross-sectional shape thereof is H-shaped. By forming the guide rods 18 to have an H-shape, the guide rods 18 can avoid attachment leg portions of the logo mark 14 or the like which are attached into the attachment holes 13 provided in the upper surface plate 3 of the buckle main body 1. Therefore, the cross-sectional shape of the guide rod 18 does not have to be H-shaped, and, for example, may be an angular U-shape whose upper side is open in order to avoid the attachment leg portion. Further, at the front surface of the base portion 15, a projecting portion 27, which projects out convexly so as to cover a space between the engaging rods 16, is provided for reinforcement.

Figure 3:
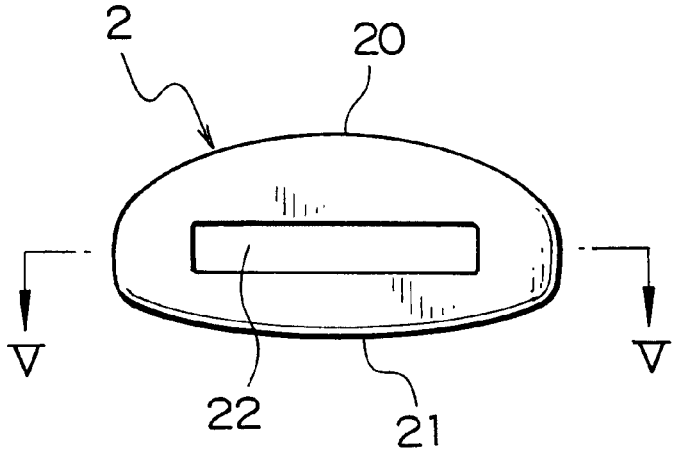
FIG. 3 is a front view of the insert-in body.
Figure 4:
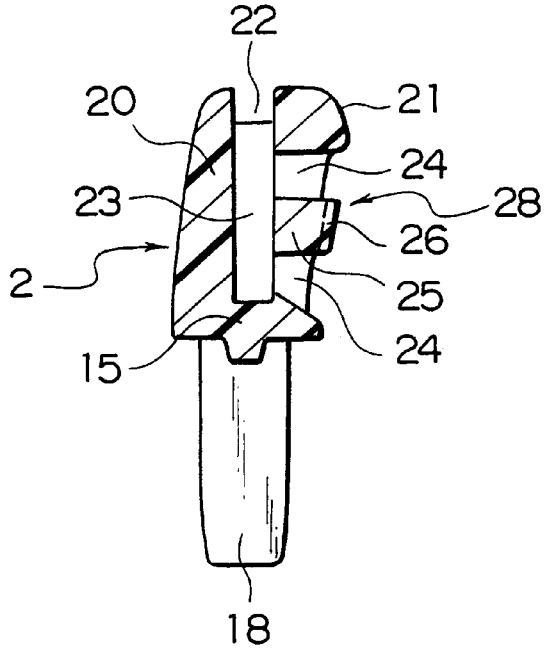
FIG. 4 is a cross-sectional view of the insert-in body taken along the line IV—IV in FIG. 2.
Figure 5:
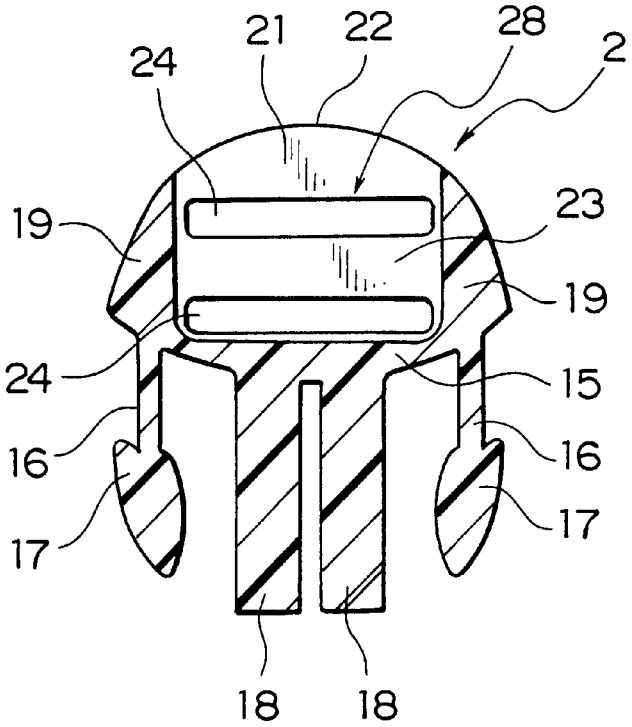
FIG. 5 is a cross-sectional view of the insert-in body taken along the line V—V in FIG. 3.

As shown in FIG. 5, support portions 19 having substantially right angled triangular shape are formed to project at the both side ends of the opposite surface of the base portion 15 which is arc shaped. An upper surface plate 20 is disposed in a bridge-like manner so as to connect the surfaces of the support portions 19, and a lower surface plate 21 is disposed in a bridge-like manner so as to connect the rear surfaces of the support portions 19. As shown in FIG. 4, the upper surface plate 20 and the lower surface plate 21 overlap each other. The lower surface plate 21 cannot be viewed from the top surface side of the insert-in body 2 due to the upper surface plate 20. Between the left and right support portions 19, a belt insertion hole 22 is provided between the upper surface plate 20 and the lower surface plate 21. A belt passage portion 23 is formed from the insertion hole 22 toward the base portion 15. The insert-in body 2 is thus formed to a flat tubular body as shown in FIG. 3.

Figure 6:
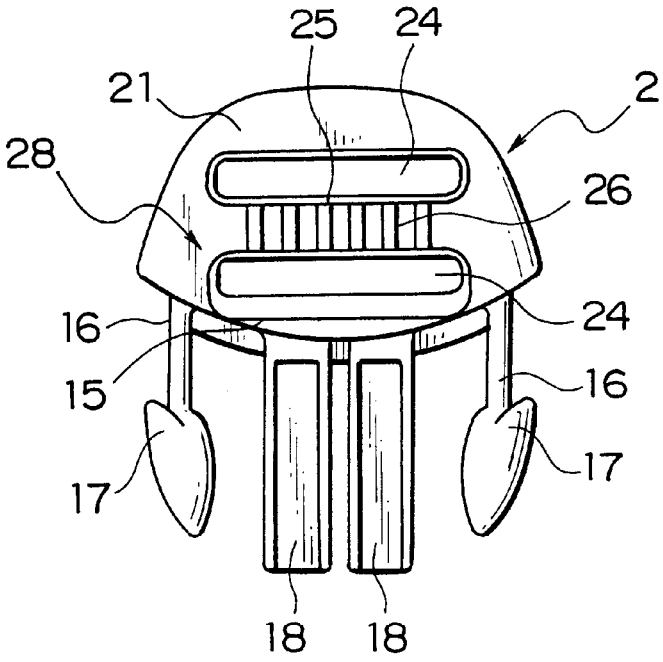
FIG. 6 is a bottom view of the insert-in body.

As shown in FIG. 2, at each of the upper surface plate 20 and the lower surface plate 21, the base portion 15 side is swelled out in an arc shape along the base portion 15, and the belt insertion hole 22 side is also formed so as to swell out in an arc-shape, thus providing enlarged portions. As shown in FIG. 6, a belt attaching portion 28 for attaching the belt is provided at the enlarged portion of the lower surface plate 21. Further, two through holes 24 for a belt through which the belt can be inserted are drilled at the attaching portion 28, and a catch rod 25 for catching the belt is provided at the attaching portion 28. The surface of the catch rod 25 is formed to have an appropriately configured uneven and control slipping of the belt, so as to form a belt adjustment portions 26. The belt adjustment portion 26 enables the length of the belt to be easily adjusted by passing the belt through the one insertion hole 22 and the two through holes 24. The insert-in body 2 is shaped in a flat, rugby ball shape as seen from the side of the insertion hole 22. In plan view as well, the overall shape of the insert-in body 2 is based on curves, as a whole.

The above-described embodiment of the buckle is formed such that the adjusting of the length of the belt can be carried out at the insert-in body 2. However, the buckle may be formed such that the adjusting of the length of belt can be carried out at the buckle main body 1. For example, the two through holes 24 for a belt which communicate with the insertion hole 7 may be formed at the belt attaching portion 9 which is provided at the insertion hole 7 side end portion of the lower surface plate 4 in the buckle main body 1. An uneven pattern may be formed on the surface of the catch rod 25 formed between the through holes 24 such that the slipping of the inserted-through belt is controlled and adjustment of the length of the belt can be carried out easily. Therefore, one through hole 24 for a belt, which communicates with the belt passage portion 23, may be formed at the belt attaching portion 28 of the lower surface plate 21 in the insert-in body 2, and one end of the belt may be inserted into the through hole 24 and folded over, and fixed by a proper stopping means. Further, the two through holes 24 for a belt may be formed at both of the belt attaching portions 9 and 28 of the buckle main body 1 and the insert-in body 2, and the length of the belt may be adjusted at both of the buckle main body 1 and the insert-in body 2.

Figure 13:
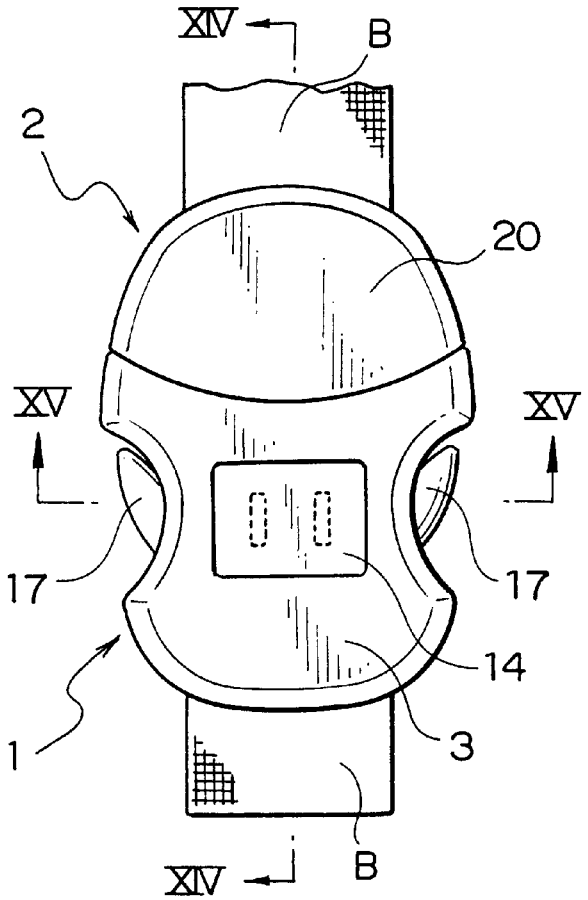
FIG. 13 is a plan view of the buckle showing a state in which the buckle main body and the insert-in body are engaged and combined.
Figure 14:
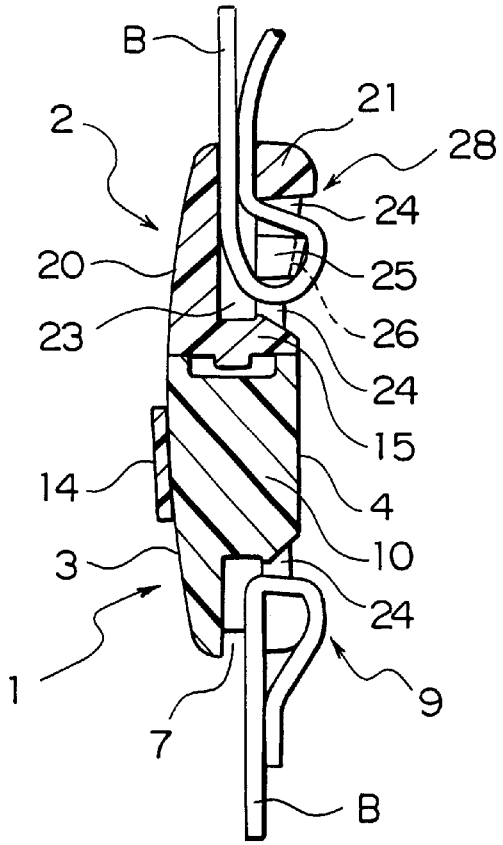
FIG. 14 is a cross-sectional view of the buckle taken along the line XIV—XIV in FIG. 13.
Figure 15:
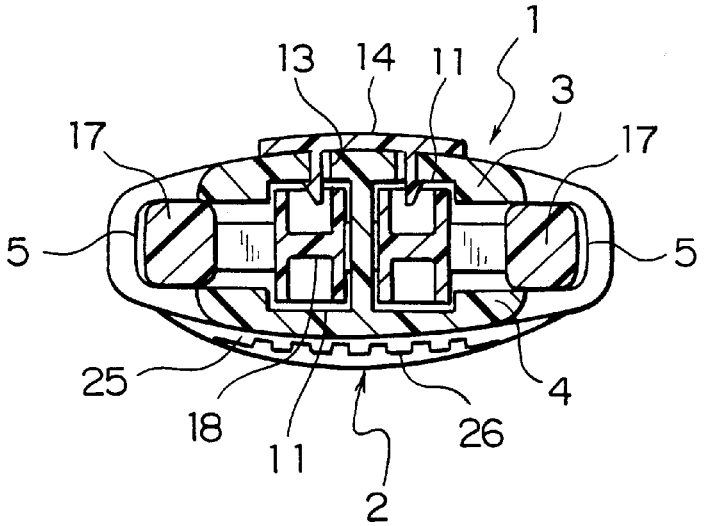
FIG. 15 is a cross-sectional view of the buckle taken along the line XV—XV in FIG. 13.

The way of using the buckle will be described hereinafter. As shown in FIGS. 13 to 15, the belt is inserted from the belt insertion hole 7 which is provided at between the upper surface plate 3 and the lower surface plate 4 of the buckle main body 1, and is passed through the through hole 24 for a belt which is formed at the belt attaching portion 9, and is fixed by sewing or the like of the end portion of the belt. Further, in the insert-in body 2, in the same way as in the buckle main body 1, the belt may be inserted from the belt insertion hole 22, and an end portion of the belt may be wound through the two through holes 24 and pulled out from the belt insertion hole 22. However, preferably, one end of the belt is inserted from one of two through holes 24 which are formed in the attaching portion 28 and the other end of the belt is inserted in the other through hole 24, and the both end portions of the belt are pulled out from the insertion hole 22. This way is easier for attaching the belt. After the belt is caught on the catch rod 25, if an end portion of the belt is pulled, the belt is strongly fastened and fixed by the uneven shaped adjustment portion 26 which is provided at the surface of the catch rod 25.

After the belt is attached to the buckle main body 1 and the insert-in body 2 as described above, the guide rods 18 and the engaging rods 16 of the insert-in body 2 are inserted from the insert-in hole 6 of the buckle main body 1. Then, the engaging portions 17 which are provided at the engaging rods 16 are engaged with the engaging holes 8 of the buckle main body 1, such that the buckle main body 1 and the insert-in body 2 are combined and fixed together. In the state in which the insert-in body 2 is inserted into the buckle main body 1 such that the buckle main body 1 and the insert-in body 2 are fixed together, as shown in FIG. 13, the entire buckle is formed in a shape which is based on arc-shaped curves and is easy to hold, and engagement and disengagement operations are easy. Thus, a buckle having an excellent design is obtained. In the buckle which is in the combined state, by pressing the engaging portions of the engaging rods 16 of the insert-in body 2, which have elasticity, toward the inner sides, the engaging portions 17 are removed from the engaging holes 8, and the insert -in body 2 can automatically be removed from the buckle main body 1 due to the elasticity of the engaging rods 16.

Figure 16:
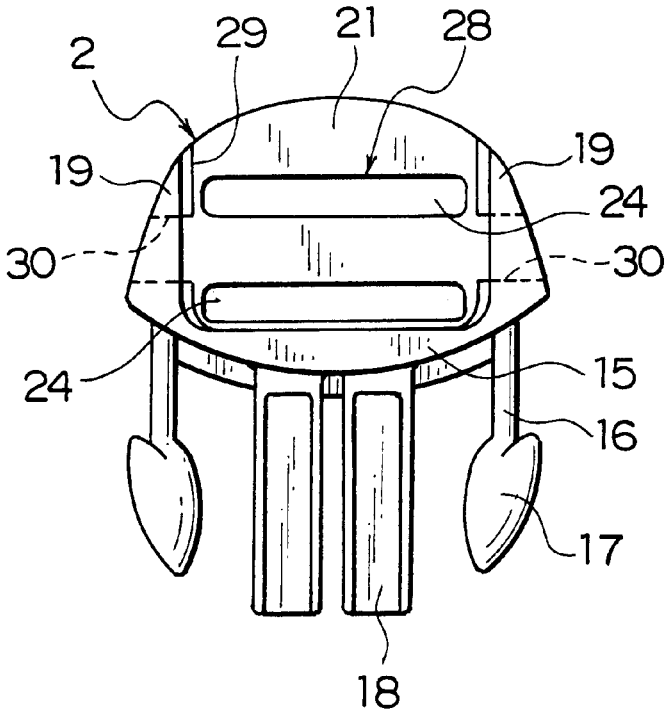
FIG. 16 is a front view showing another embodiment of the insert-in body of the buckle.

FIG. 16 is a front view showing a modification of the insert-in body 2. In accordance with this embodiment, the support portions 19 are formed on an upper surface of the lower surface plate 21, along the both sides of the opposite surface of the base portion 15 at one surface of which the engaging rods 16 and the guide rods 18 project. Further, a shelf portion 29, which is formed in a step shape being lower than the surface of the support portion 19, is provided at an inner side surface of each support portion 19. Moreover, a through hole 30, which passes through the side surface of the support portion 19, is formed in each support portion 19.

Figure 17:
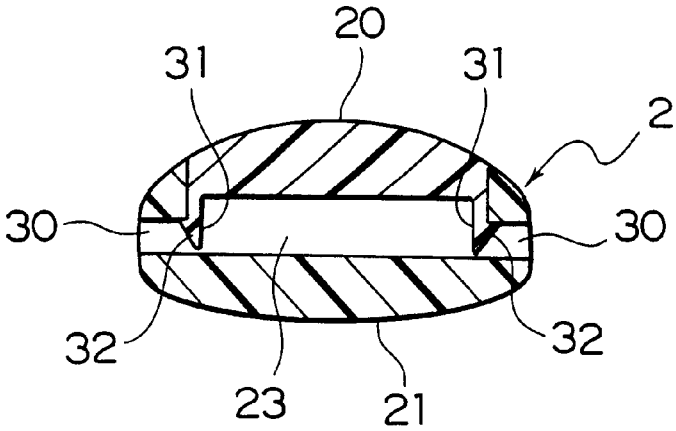
FIG. 17 is a vertical sectional view of main portions showing a state in which the insert-in body of the FIG. 16 and an upper surface plate are combined.

In the present embodiment, the upper surface plate 20 is formed as a member separate from the insert-in body 2. As shown in FIG. 17, the upper surface plate 20 is disposed such that the rear surface thereof abuts on the upper surfaces of the shelf portions 29. A pair of engaging pieces 31, which have engagement projecting portions 32 at the leading ends thereof, are formed to project at the both of the right and left side edges of the rear surface of the upper surface plate 20. The engagement projecting portions 32 are formed to be engageable with the through holes 30 which are drilled in the support portions 19. By engaging the upper surface plate 20 with the insert-in body 2, the belt insertion hole 22 and the passage portion 23 are formed between the upper surface plate 20 and the lower surface plate 21. Thus, the belt which is attached to the belt attaching portion 28 is hidden and cannot be viewed from the top surface of the insert-in body 2, and the attachment of the belt can be maintained stable.

FIGS. 18 to 21 show the buckle of the second embodiment of the invention. In these figures, the same numerals are attached to the substantially same parts with the above-described first embodiment of the invention.

Figure 18:
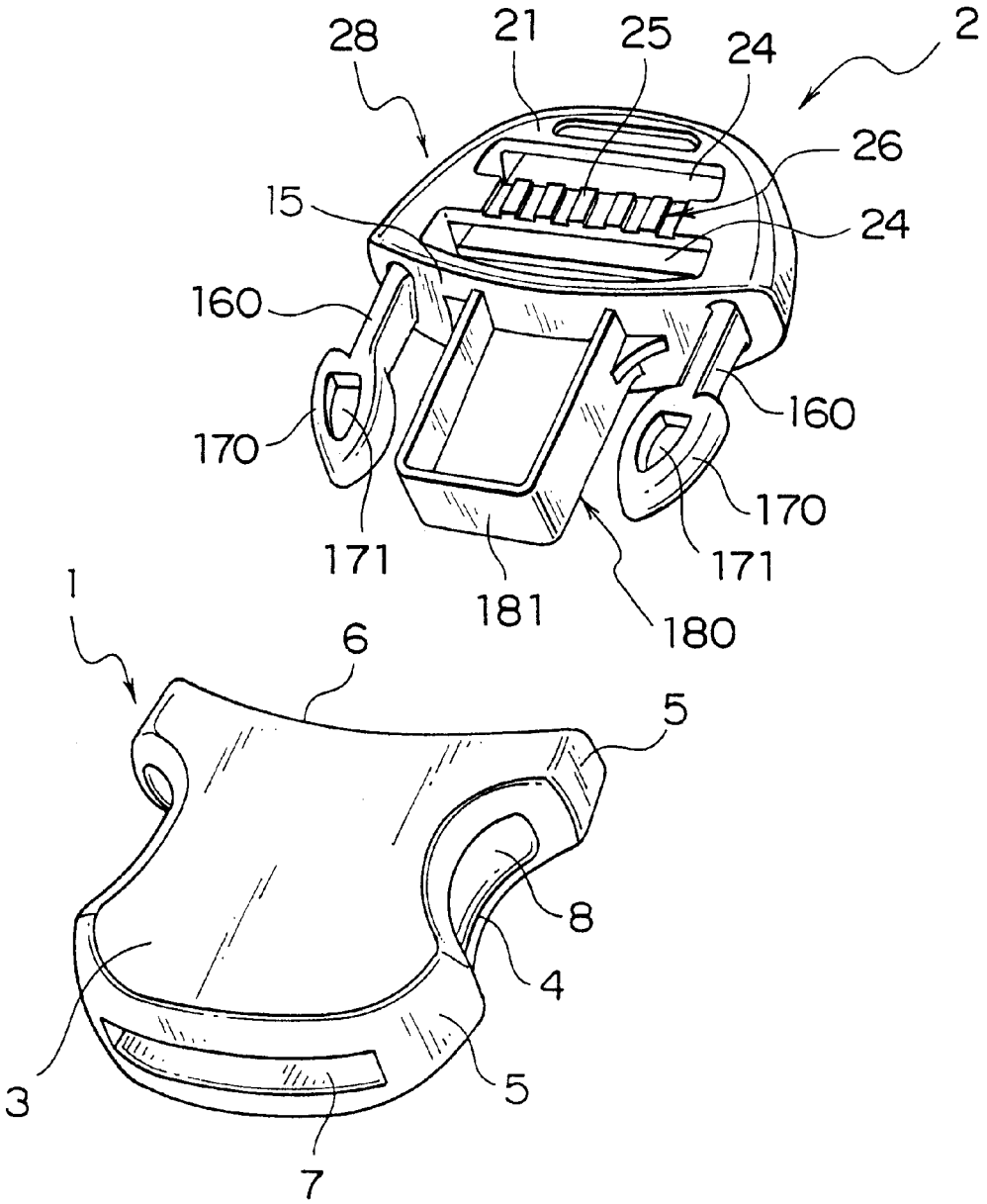
FIG. 18 is a perspective view of a buckle of the second embodiment formed from a buckle main body and an insert-in body.
Figure 20:
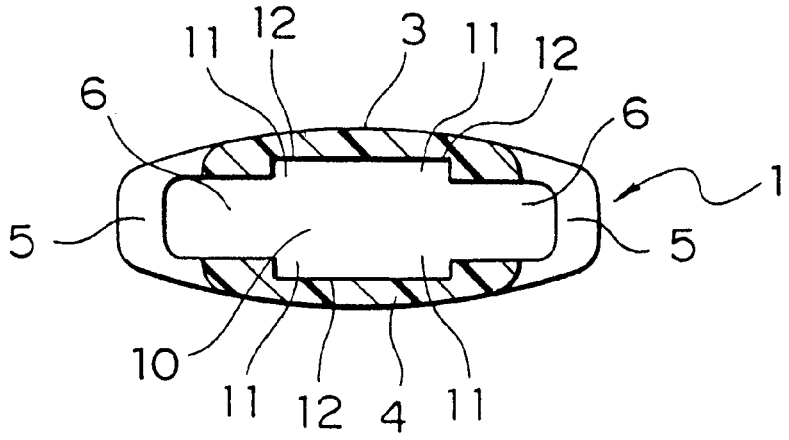
FIG. 20 is a cross-sectional view of the buckle main body corresponding to FIG. 9.
Figure 21:
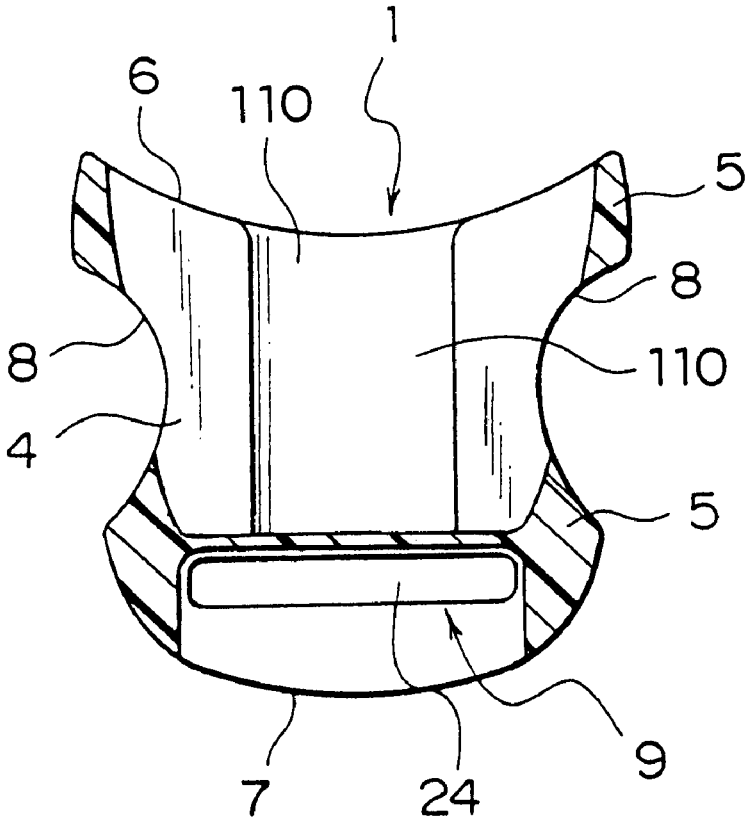
FIG. 21 is a cross-sectional view of the buckle main body corresponding to FIG. 11.

In this embodiment, the belt attaching portion 9 for attaching the belt is also provided at the belt insertion hole 7 side of the buckle main body 1 and the through hole 24 for inserting the belt is also formed at the attaching portion 9, as shown in FIGS. 18 and 21. And as shown in FIGS. 20 and 21, a guide groove 110, which guides a later-mentioned guide rod 180, is formed in the center of inner surfaces of the upper surface plate 3 and the lower surface plate 4. The partition wall 10 to divide the guide groove 110 into right and left, which is formed in the first embodiment, is not formed in this embodiment, so as to form the single guide groove 110. Therefore, the breadth of the groove of the guide groove 110 is set substantially as same as the breadth of the guide rod 180 of the insert-in body 2. Further, in this embodiment, attachment holes 13 for attaching a logo mark or the like is not formed on the upper surface plate 3.

Figure 19:
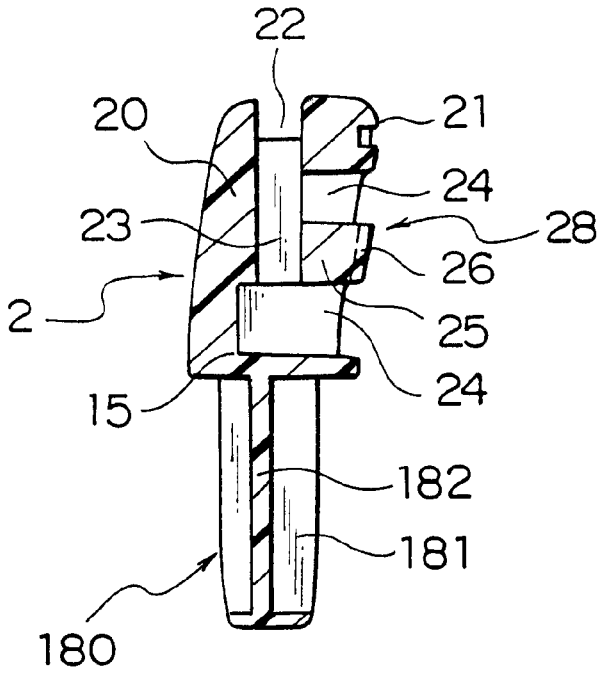
FIG. 19 is a cross-sectional view of the insert-in body corresponding to FIG. 4.

In the insert-in body 2, as shown in the FIGS. 18 and 19, a pair of engaging rods 160 are protruded elastically so as to be parallel to one another at the both side ends of the base portion 15, which swells out in an arc shape, as well as in the first embodiment, and each of the engaging rods 160 have an engaging portion 170, which can engage with the engaging hole 8 of the buckle main body 1 at a tip of the engaging rod 160. The guide rod 180, which is inserted into the guide groove 110 provided at the buckle main body 1, is formed to project between the engaging rods 160. Further, a concave portion 171 is formed in the center of the engaging portion 170.

As shown in the FIG. 18, the guide rod 180 is composed of a substantially U-shaped frame portion 181 and an intermediate wall 182, which divides the space surrounded by the intermediate wall 182 and the base portion 15 into two parts, upper and lower parts. Further, the support portions 19 having substantially right angled triangular shape are formed to project at the both side ends of the opposite surface of the base portion 15 which is arc shaped, and the front and rear surfaces of the support portion 19 is connected with the upper surface plate 20 and the lower surface plate 21. Between the left and right support portions 19, the belt insertion hole 22 is provided between the upper surface plate 20 and the lower surface plate 21. The belt passage portion 23 is formed from the insertion hole 22 toward the base portion 15.

The belt attaching portion 28 for attaching the belt is provided at the enlarged portion of the lower surface plate 21. Further, the two through holes 24 for a belt through which the belt can be inserted are formed at the attaching portion 28, and the catch rod 25 for catching the belt is provided between the through holes 24. The catch rod 25 is formed to have an uneven surface, so as to control slipping of the belt. In this embodiment, the through hole 24 by the side of the base portion 15 is formed larger than the through hole 24 of the first embodiment, and the thickness of this base portion 15 is made thinner. Consequently, the belt is easily pulled put.

Thus, in this embodiment, the buckle main body 1 and the insert-in body 2 eliminate the unnecessary parts as much as possible, thereby attaining the large loss of the amount of resin used, as well as simplification of the configuration in the invention.

Figure 22:
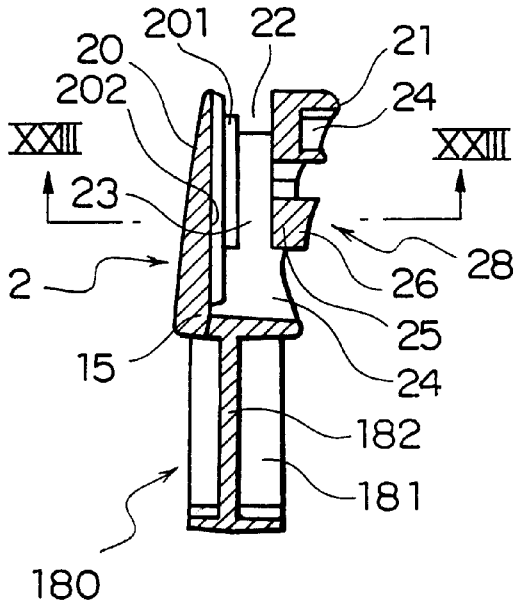
FIG. 22 is a cross-sectional view corresponding to FIG. 19.
Figure 23:
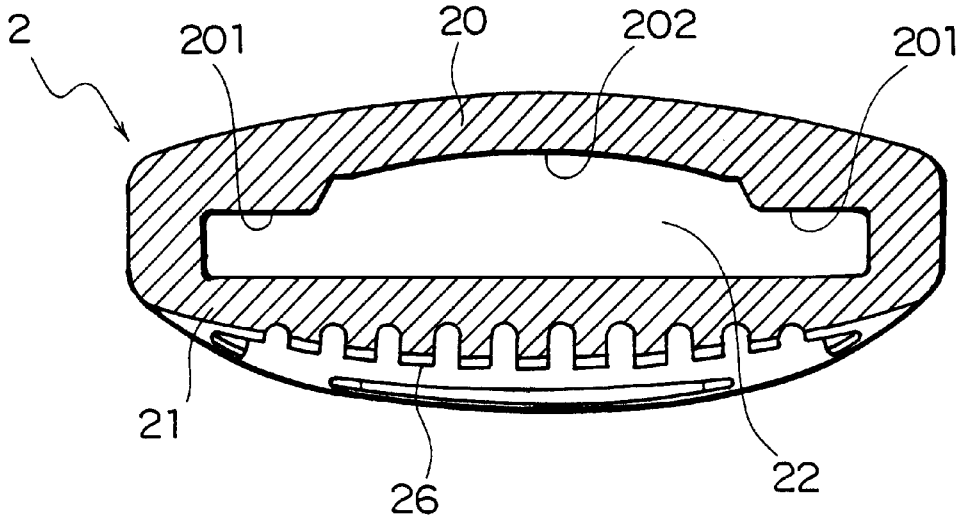
FIG. 23 is a cross-sectional view of the insert-in body 2 taken along the line XXIII—XXIII in FIG. 22.
Figure 24:
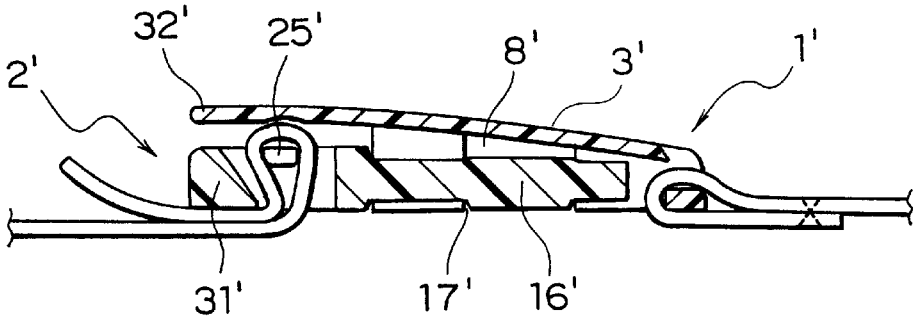
FIG. 24 is a cross-sectional view of a well-known buckle.
Figure 25:
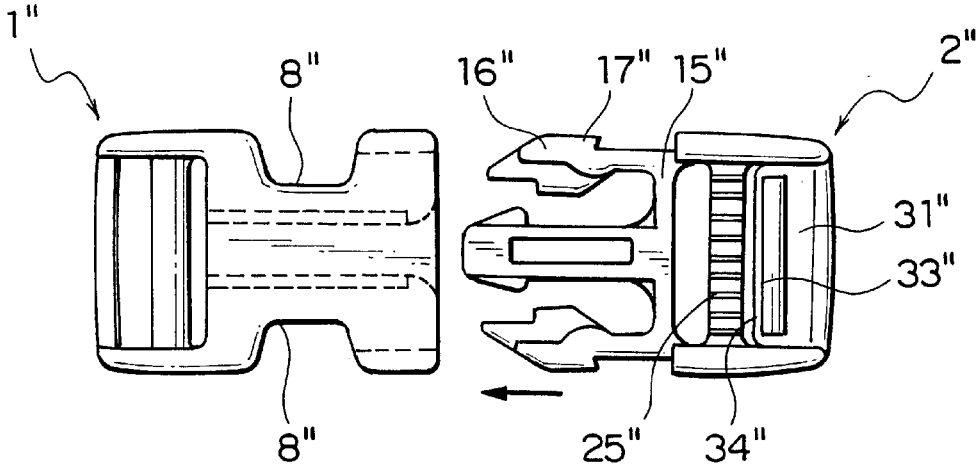
FIG. 25 is a plan view of another well-known buckle.

FIGS. 22 to 23 show the modification of the insert-in body 2 of the buckle of the aforementioned second embodiment, which is shown in FIGS. 18 to 21. FIG. 22 is the cross-sectional view corresponding to FIG. 19, and FIG. 23 is a cross-sectional view of the insert-in body 2 taken along the line XXIII—XXIII in FIG. 22.

According to this modification, as shown in both of above figures, a recess portion 202 is formed in the center of the insert-in body 2 with both of right and left end portions 201 of the upper surface plate of the insert-in body 2 being left, so as to made a portion of the upper surface plate 20 thin. Thus, the recess portion 202 is formed on the inner surface of the upper surface plate 20 so as to extend from a slightly inner position of the end portion of the opposite side to the base portion 15 of the insert-in body 2 up to the end of the catch rod 25 by the side of the base portion 15. Consequently, the space between the upper surface plate 20 and the lower surface plate 21 is expanded in the area of the recess portion 202.

Therefore, the space between the right and left end portions 201 of the upper surface plate 20, which is disposed so as to sandwich the recess portion 202, and the inner surface of the lower surface plate 21 is equal to that of the belt insertion hole of the second embodiment. Thus, the belt, which is not illustrated, may easily inserted into the belt insertion hole 22. Additionally, when the belt inserted into the belt insertion hole 22 is inserted through the two through holes 24, wound onto the catch rod 25 and pulled out from the belt insertion hole 22, right and left edge portions of the belt is respectively thrust through the narrow space between the right and left end portions 201 of the belt insertion hole 22 and the lower surface plate 21. Consequently, the belt is not unstable in the belt insertion hole 22 and smooth attachment of the belt may be secured. At the same time, the amount of the resin used for forming the recess portion 202 may be reduced.

What is claimed is:

1. A buckle, wherein engaging rods, which have engaging portions at outer sides thereof, are provided at both sides of a base portion of an insert-in body, and at least a guide rod is protruded at a center of the base portion, and at an opposite surface of the base portion are provided a lower surface plate having a belt attaching portion and an upper surface plate covering a surface of the lower surface plate, and a belt insertion hole is formed between the upper surface plate and the lower surface plate, and a buckle main body is formed from an upper surface plate, a lower surface plate, and side walls, and an insert-in hole for the insert-in body is provided at one end of the buckle main body, and a belt insertion hole is provided at another end of the buckle main body, and a belt attaching portion is provided at an end portion of the low surface plate, and through holes for a belt which communicate with the belt insertion holes are formed at the belt attaching portions, and engaging holes which engage with the engaging rods are provided at the side walls, and wherein the two through holes for a belt are formed at least one of the belt attaching portions, a catch rod for catching the belt is formed between the through holes, and a surface of the catch rod is formed in an uneven shape so as to form a belt adjustment portion.

2. A buckle according to claim 1, wherein the guide rod is provided at the base portion of the insert-in body, and the guide rod is formed in a shape such that a lateral cross sectional configuration thereof is H-shaped or a shape whose upper side is open.

3. A buckle according to claim 1, wherein at least a guide groove, which extends from the insert-in hole to the through hole on facing surfaces of the upper and lower surface plates of the buckle main body and guides the guide rod, is formed at the buckle main body.

4. A buckle according to claim 3, wherein attachment holes which communicate with the guide groove are drilled in the upper surface plate of the buckle main body.

5. A buckle according to claim 1, wherein support portions are formed to project at both of right and left sides of the insert-in body, the upper surface plate is disposed in a bridge-like manner so as to connect the surfaces of the support portions and the lower surface plate is disposed in a bridge-like manner so as to connect the rear surfaces of the support portions, and the belt insertion hole is provided between both of the supporting portions, and the upper surface plate and the lower surface plate.

6. A buckle according to claim 1, wherein the base portion of the insert-in body is swelled out in an arc shape, and the belt adjustment portion is provided at an enlarged portion of the lower surface plate, and a belt insertion hole side is formed in an arc shape, and an insert-in hole side for the insert-in body of the buckle main body is cut in a curved shape, and both side end portions of the insert-in hole side of the buckle main body are formed in projected configurations, and a belt insertion hole side is formed in an arc shape.

* * * * *